US006933708B2

(12) United States Patent
Hamon et al.

(10) Patent No.: US 6,933,708 B2
(45) Date of Patent: Aug. 23, 2005

(54) VOLTAGE REGULATOR WITH REDUCED OPEN-LOOP STATIC GAIN

(75) Inventors: Cécile Hamon, Grenoble (FR); Christophe Bernard, Claix (FR); Alexandre Pons, Fontaine (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/451,593

(22) PCT Filed: Dec. 21, 2001

(86) PCT No.: PCT/FR01/04174

§ 371 (c)(1),
(2), (4) Date: Jun. 23, 2003

(87) PCT Pub. No.: WO02/052364

PCT Pub. Date: Jul. 4, 2002

(65) Prior Publication Data

US 2004/0061485 A1 Apr. 1, 2004

(30) Foreign Application Priority Data

Dec. 22, 2000 (FR) ..... 00 16978

(51) Int. Cl.[7] ..... G05F 1/40
(52) U.S. Cl. ..... 323/280
(58) Field of Search ..... 323/280, 279, 323/364, 273

(56) References Cited

U.S. PATENT DOCUMENTS

| | | | | |
|---|---|---|---|---|
| 4,890,016 A | * | 12/1989 | Tanaka et al. | 326/27 |
| 5,168,209 A | | 12/1992 | Thiel, V | 323/313 |
| 5,552,697 A | * | 9/1996 | Chan | 323/282 |
| 5,631,598 A | | 5/1997 | Miranda et al. | 327/540 |
| 5,867,015 A | | 2/1999 | Corsi et al. | 323/316 |
| 5,982,226 A | | 11/1999 | Rincon-Mora | 327/541 |
| 6,861,827 B1 | * | 3/2005 | Yang et al. | 323/273 |

FOREIGN PATENT DOCUMENTS

EP 0 957 421 B1 9/2003

* cited by examiner

*Primary Examiner*—Shawn Riley
(74) *Attorney, Agent, or Firm*—Lisa K. Jorgenson; Harold H. Bennett, II; Seed IP Law Group PLLC

(57) ABSTRACT

A voltage regulator having an output terminal adapted to being connected to a load, including an operational amplifier having its non-inverting input connected to a first reference voltage, and its inverting input connected to the output terminal, an inverting stage having its input connected to the output of the operational amplifier, a power switch controlled by the output of the inverter stage, arranged between the output terminal and a supply voltage, and a charge capacitor arranged between the output terminal and a reference supply voltage, including a means for reducing the effective output impedance of the operational amplifier.

25 Claims, 3 Drawing Sheets

VOLTAGE REGULATOR WITH REDUCED OPEN-LOOP STATIC GAIN

BACKGROUND OF THE INVENTION

1. Technical Field of the Invention

The present invention relates to the field of voltage regulators and in particular to regulators with a low drop-out.

2. Description of the Related Art

A low drop-out regulator made in an integrated circuit may be used to provide a predetermined voltage with low noise to a set of electronic circuits from a supply voltage provided by a rechargeable battery. Such a supply voltage decreases in time and is likely to include noise caused by neighboring electromagnetic radiations on the battery-to-regulator connections. The regulator is said to have a low drop-out since it enables providing a voltage close to the supply voltage.

FIG. 1 schematically shows an example of a conventional low drop-out regulator 2. The regulator includes an output terminal S intended for being connected to a load R. Load R, essentially resistive, represents the sum of the input impedances of the circuits supplied by the regulator. For simplicity, it is considered hereafter that load R is a resistor. The regulator includes an operational amplifier 4 having a non-inverting input $IN^+$ connected to a positive reference voltage Vref and having an inverting input $IN^-$ connected to the terminal S by a feedback loop. Voltage Vref is generated in a known manner by a constant voltage source (not shown) with a high output impedance. Operational amplifier 4 is supplied between a positive supply voltage Vbat provided by the battery and a ground voltage GND. An inverting stage 6, supplied between voltages Vbat and GND, receives the output of operational amplifier 4 and its output is connected to the gate of a P-channel MOS power transistor T1 having its drain connected to output terminal S and its source connected to voltage Vbat. Transistor T1 is of MOS type rather than bipolar, especially to minimize the difference between output voltage Vout of terminal S and supply voltage Vbat. A charge capacitor C is arranged between output terminal S and voltage GND.

FIG. 2 schematically shows an example of forming of operational amplifier 4 of FIG. 1. Two P-channel MOS transistors T2, T3 have their sources connected to each other and their gates respectively connected to inputs $IN^-$ and $IN^+$. A bias current source CS1 is arranged between voltage Vbat and the sources of transistors T2 and T3. Transistors T2 and T3 form a differential pair. Two N-channel MOS transistors T4 and T5 have their sources connected to voltage GND and their gates connected to each other. The drains of transistors T4 and T5 are respectively connected to the drains of transistors T2 and T3. The drain of transistor T3 is connected to the gates of transistors T4 and T5. Transistors T4 and T5 form an active load of the differential pair formed by transistors T2 and T3. The drain of transistor T2 forms the output of amplifier 4.

A voltage regulator of FIG. 1 maintains voltage Vout of output terminal S to a value equal to reference voltage Vref. Any variation in voltage Vbat translates as a variation in voltage Vout, which is transmitted by the feedback loop on input $IN^-$. When the regulator operates properly, the variation in the voltage of input $IN^-$ causes the return of voltage Vout to voltage Vref. For this purpose, the regulator circuit, which forms a looped system between input $IN^-$ and terminal S must be a stable system. For this system to be stable when looped, its open-loop gain must not exceed 1 when the phase shift is smaller than −180° (when there is a phase opposition between the system input and output).

FIG. 3 illustrates, according to frequency f, the variation of gain G and of phase shift $\phi$ of the open-loop regulator taken between input $IN^-$ and terminal S. For low frequencies f, gain G is equal to static gain Gs of the open-loop regulator. The elements forming the regulator each have a gain which varies according to frequency. The cut-off frequency of an element having a gain that decreases when the frequency increases forms a "pole" of the transfer function of the open-loop regulator. Each pole of the transfer function of the open-loop regulator introduces a drop of 20 dB per decade in gain G. Further, each pole of the transfer function of the open-loop regulator introduces a phase shift $\phi$ of 90°. For simplicity, it is considered hereafter that the transfer function of the open-loop regulator only includes one main pole P0 and one secondary pole P1. The frequency of main pole P0 especially depends on the inverse of the product of charge resistance R and of capacitance C. The frequency of secondary pole P1 especially depends on the gate impedance of transistor T1. It is considered that inverter stage 6 is an ideal stage that introduces no pole. The features of the elements forming the regulator are chosen in such a way that when phase shift $\phi$ becomes equal to −180°, gain G is smaller than the unity gain (0 dB). In FIG. 3, pole P0 is at a rather low frequency and pole P1 is at a frequency greater than the frequency of pole P0. For a frequency smaller than the frequency of pole P0, the gain is equal to static gain Gs of the open-loop regulator. Between poles P0 and P1, the gain drops by 20 decibels per decade. Beyond pole P1, the gain drops by 40 decibels per decade. The phase shift drops from 0 to −90° at pole P0 and from −90° to −180° at pole P1. Static gain Gs of the regulator is equal to Gs4*Gs6*Gs1, where Gs4 is the static gain of operational amplifier 4, Gs6 is the static gain of inverter stage 6, and Gs1 is the static gain of transistor T1. The static gain of operational amplifier 4 has the following form:

$$Gs4=G_m2*(R2*R4)/(R2+R4)=G_m2*Zout$$

where Gm2 is the transconductance of transistor T2, and R2, R4 are the on-state resistances, called the Early resistances, of transistors T2 and T4. Ratio (R2*R4)/(R2+R4) is output impedance Zout of the operational amplifier.

The Early resistances of transistors T2 and T4 are high, and output impedance Zout and static gain Gs4 of amplifier 4 have a high value. A strong gain Gs4 makes static gain Gs high, which shifts the gain curve upwards and makes the regulator stability difficult to obtain.

With the improvement of technologies, the features of an operational amplifier improve and its gain Gs4 especially tends to increase.

FIG. 3 illustrates a gain curve G' of an open-loop regulator having the two preceding poles P0, P1 and having a static gain Gs' greater than the preceding static gain Gs. Gain G' is greater than 1 (0 dB) when phase shift $\phi$ reaches value −180°, which makes the regulator unstable.

A conventional way to solve this problem consists of increasing the capacitance of capacitor C, which reduces the frequency of main pole P0. However, the use of a capacitor C of large dimension is not desirable. Further, it is not desirable to debase the characteristics of the transistors of an operational amplifier, given that these transistors must preferably be identical to the other transistors in the integrated circuit containing the regulator.

BRIEF SUMMARY OF THE INVENTION

An object of the present invention is to provide a stable voltage regulator with a large passband while using an output capacitor with a low capacitance.

To achieve this object, the present invention provides reducing the apparent output resistance of the operational amplifier of a regulator.

More specifically, the present invention provides a voltage regulator having an output terminal adapted to being connected to a load, including an operational amplifier having its non-inverting input connected to a first reference voltage, and its inverting input connected to the output terminal, an inverting stage having its input connected to the output of the operational amplifier, a power switch controlled by the output of the inverter stage, arranged between the output terminal and a supply voltage, and a charge capacitor arranged between the output terminal and a reference supply voltage, including a means for reducing the effective output impedance of the operational amplifier.

According to an embodiment of the present invention, the impedance reduction means includes a first resistor having a first terminal connected to the output of the operational amplifier, a diode-connected MOS transistor having its drain connected to a second terminal of the first resistor and its source connected to the second reference voltage, and a means for biasing the diode-connected transistor in the on state.

According to an embodiment of the present invention, the first resistance has a value much smaller than the output impedance of the operational amplifier.

According to an embodiment of the present invention, the operational amplifier includes first and second MOS transistors, of a first type, having their sources connected to each other and their gates respectively connected to the inverting and non-inverting inputs, a current source arranged between the supply voltage and the sources of the first and second transistors, third and fourth MOS transistors, of a second type, having their sources connected to the first reference voltage, having their gates connected to each other, and having their drains respectively connected to the drains of the first and second transistors, the drain of the first transistor being connected to the output of the operational amplifier and the drain and the gate of the fourth transistor being interconnected.

According to an embodiment of the present invention, the inverting stage includes a fifth MOS transistor, of the type of the third and fourth transistors, having its gate and its drain respectively connected to the input and to the output of the inverting stage, and having its source connected to the first reference voltage, an impedance arranged between the output of the inverting stage and the supply voltage, and a capacitor and a second resistor arranged in series between the input and the output of the inverting stage.

According to an embodiment of the present invention, the power switch is a sixth MOS transistor of the type of the first and second transistors.

According to an embodiment of the present invention, the first, second, and sixth transistors are P-channel MOS transistors and the third, fourth, and fifth transistors are N-channel MOS transistors.

BRIEF DESCRIPTION OF THE SEVERAL VIEWS OF THE DRAWINGS

The foregoing objects, features and advantages of the present invention will be discussed in detail in the following non-limiting description of specific embodiments in connection with the accompanying drawings, in which.

DETAILED DESCRIPTION OF THE INVENTION

Only those elements that are necessary to the understanding of the present invention have been shown in the different drawings. Same references represent same elements in the different drawings.

Figure 4:
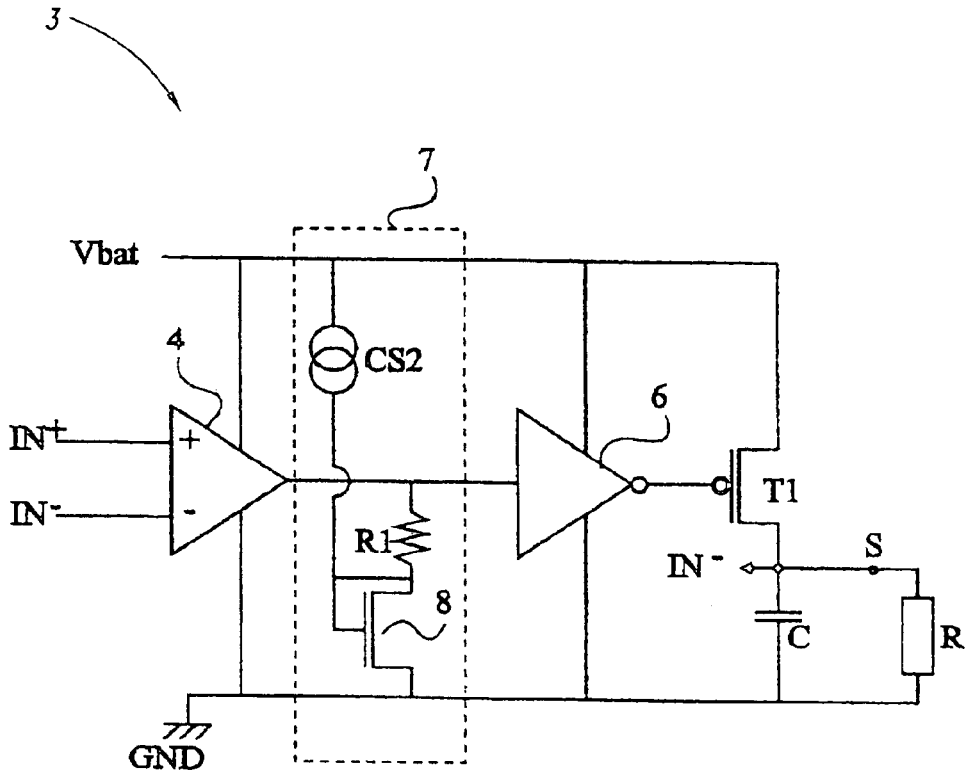
FIG. 4 schematically shows an embodiment of a regulator according to the present invention.

FIG. 4 schematically shows an embodiment of a regulator 3. The regulator includes the already described elements of a conventional regulator and an impedance reduction circuit 7 connected to the output of operational amplifier 4.

A resistor R1 has a first terminal connected to the output of operational amplifier 4. An N-channel MOS transistor 8 has its drain connected to a second terminal of resistor R1 and its source connected to voltage GND. The drain and the gate of transistor 8 are interconnected so that transistor 8 is diode-connected. A source CS2 of a current for biasing diode-connected transistor 8 is connected between voltage Vbat and the drain of transistor 8.

Current source CS2 is chosen so that diode-connected transistor 8 is permanently on. Transistor 8 is chosen so that the voltage drop between its drain and its source is equal to the voltage existing between the input of inverter stage 6 and ground voltage GND. As a result, the voltage drop across resistor R1 is substantially null and operational amplifier 4 is not imbalanced by a current flowing through resistor R1. Impedance Z of diode-connected transistor 8 and of resistor R1 connected in series is equal to:

$$Z=R1+(1/G_m8)$$

where $G_m8$ is the transconductance of transistor 8. Resistor R1 and transistor 8 are chosen so that impedance Z is much smaller than output impedance Zout of the operation amplifier. Static gain Gs4 of operational amplifier 4 having its output OUT connected in parallel on impedance Z is equal to Gs4=Gm2*(Zout*Z)/(Zout+Z), that is, substantially Gm2*Z. The present invention enables reducing the static gain of the open-loop voltage regulator. Thus, the reduction of the apparent output impedance of operational amplifier 4 corresponds to a reduction in the gain of this amplifier. This gain may be adjusted to keep a stable system with a large passband, with a capacitor C of small value.

The present invention has been described in relation with an ideal inverter stage 6 which introduces no pole in the transfer function of the open-loop voltage regulator. In practice, inverter stage 6 is not an ideal amplifier stage, but is for example a so-called "Miller" amplifier stage. Such an amplifier stage especially has the function of increasing the frequency at which secondary pole P1 is located to increase the passband of the open-loop voltage regulator. A Miller stage especially introduces a pole P2 and a zero Z1 in the transfer function of the open-loop voltage regulator.

Figure 1:
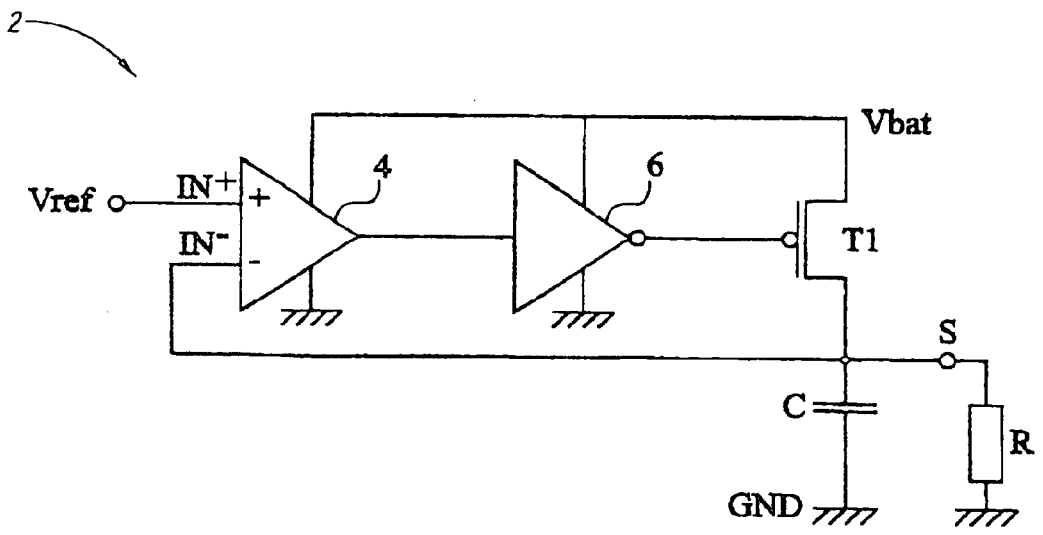
Fig. 1 (Prior Art)
FIG. 1, previously described, schematically shows a conventional voltage regulator, according to known art.
Figure 2:
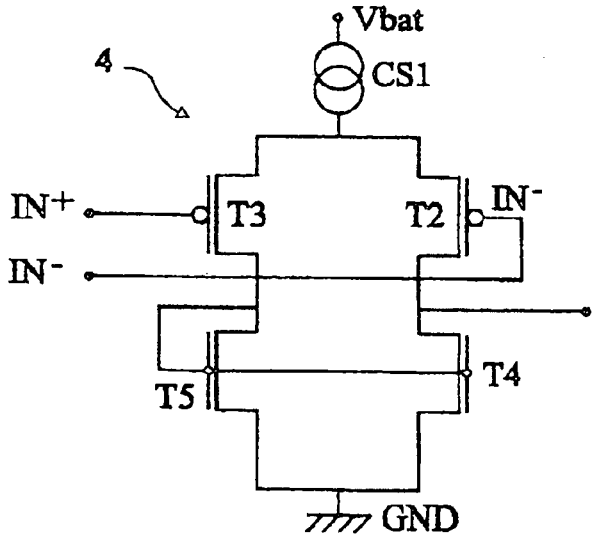
Fig. 2 (Prior Art)
FIG. 2, previously described, schematically shows an embodiment of an operational amplifier, according to known art.
Figure 3:
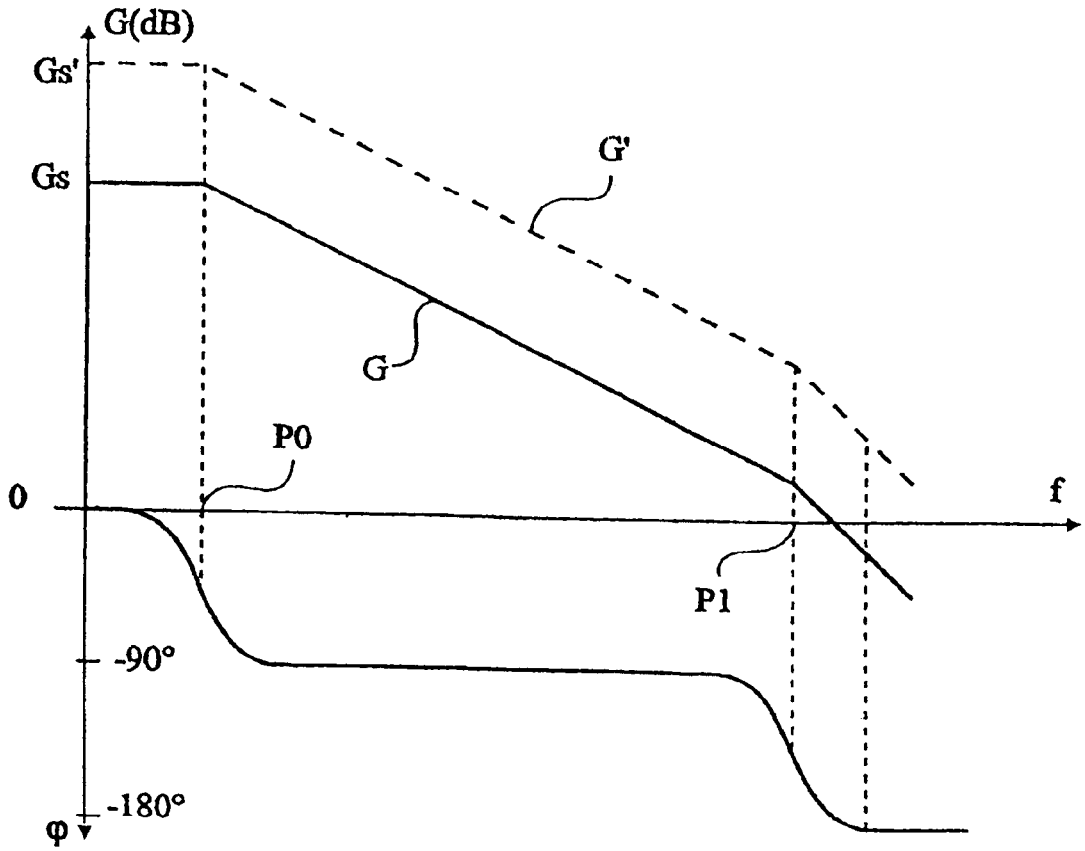
Fig. 3 (Prior Art)
FIG. 3, previously described, illustrates the gain and phase shift according to frequency of the regulator of FIG. 1 in open loop.
Figure 5:
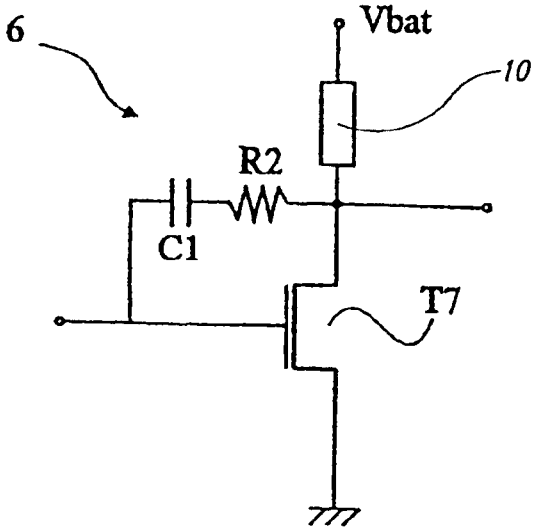
FIG. 5 schematically shows an embodiment of an inverter that can be used according to the present invention.

FIG. 5 schematically shows an embodiment of an inverter stage 6 of amplifier circuit 2' in the form of a Miller stage. Inverter stage 6 includes an N-channel transistor T7, having its gate and its drain respectively connected to the input and to the output of stage 6. The source of transistor T7 is connected to voltage GND. An impedance 10 is arranged between the output of stage 6 and voltage Vbat. A capacitor C1 and a resistor R2 are arranged in series between the input and the output of the amplifier stage. The value of capacitor C1, of resistor R2, and the gain of transistor T7 especially enable adjusting the frequencies of poles P1, P2. The voltage drop across diode-connected transistor 8 is in this case chosen to be equal to the gate/source voltage of transistor T7. The reduction in the output impedance connected at the input of inverter stage 6 also results in increasing the frequency of P2 introduced by stage 6, which is an additional advantage of the present invention.

Of course, the present invention is likely to have various alterations, modifications, and improvements which will readily occur to those skilled in the art. As an example, the present invention has been described in relation with a specific operational amplifier, but those skilled in the art will easily adapt the present invention to a voltage regulator using other types of operational amplifiers.

The present invention has been described in relation with a voltage regulator using a power transistor T1, but those skilled in the art will easily adapt the present invention to a voltage regulator using another type of voltage-controlled power switch.

The present invention has been described in relation with positive voltages Vbat and Vref, but those skilled in the art will easily adapt the present invention to negative voltages Vbat and Vref, by inverting the described types of MOS transistors and the connection of diode-connected transistor 8.

For simplicity, the present invention has been described in relation with a resistive load R, but those skilled in the art will easily adapt the present invention to a complex load.

For simplicity, the present invention has been described in relation with a voltage regulator using a non-resistive feedback loop and providing a voltage equal to a received reference voltage Vref. However, those skilled in the art will easily adapt the present invention to a voltage regulator in which the feedback loop includes a resistive bridge, and which outputs a voltage different from the received voltage Vref.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A voltage regulator having an output terminal adapted to being connected to a load, including:

an operational amplifier having a non-inverting input connected to a first reference voltage, and an inverting input connected to the output terminal, an inverting stage having an input connected to the output of the operational amplifier, a power switch controlled by an output of the inverter stage, arranged between the output terminal and a supply voltage, a charge capacitor arranged between the output terminal and a reference supply voltage, and means for reducing the effective output impedance of the operational amplifier independently of the operating frequency.

2. The voltage regulator of claim 1, wherein the impedance reduction means includes a first resistor having a first terminal connected to the output of the operational amplifier, a diode-connected MOS transistor having a drain connected to a second terminal of the first resistor and a source connected to the second reference voltage, and means for biasing the diode-connected transistor in the on state.

3. The voltage regulator of claim 2, wherein the first resistance has a value much smaller than the output impedance of the operational amplifier.

4. The voltage regulator of claim 3, wherein the operational amplifier includes:

first and second MOS transistors, of a first type, having sources connected to each other and gates respectively connected to the inverting and non-inverting inputs, a current source arranged between the supply voltage and the sources of the first and second transistors, third and fourth MOS transistors, of a second type, having sources connected to the first reference voltage, having gates connected to each other, and having drains respectively connected to drains of the first and second transistors, the drain of the first transistor being connected to the output of the operational amplifier and the drain and the gate of the fourth transistor being interconnected.

5. The voltage regulator of claim 4, wherein the inverting stage includes:

a fifth MOS transistor, of the type of the third and fourth transistors, having a gate and a drain respectively connected to the input and to the output of the inverting stage, and having a source connected to the first reference voltage, an impedance arranged between the output of the inverting stage and the supply voltage, and a capacitor and a second resistor arranged in series between the input and the output of the inverting stage.

6. The voltage regulator of claim 4, wherein the power switch is a sixth MOS transistor of the type of the first and second transistors.

7. The voltage regulator of claim 5, wherein the first, second, and sixth transistors are P-channel MOS transistors and wherein the third, fourth, and fifth transistors are N-channel MOS transistors.

8. An impedance reduction circuit, comprising:

an output node;

a diode having a first terminal connected to a current source and a second terminal connected to a circuit ground; and a resistive element having a first terminal connected to the output node and a second terminal connected to the first terminal of the diode.

9. The circuit of claim 8, wherein the diode is a MOS transistor having a first conduction terminal and a control terminal tied together to form the first terminal of the diode, and a second conduction terminal forming the second terminal of the diode.

10. The circuit of claim 8, wherein the current source is biased such that the diode is in an on state.

11. A method for regulating a voltage, comprising:

comparing a voltage at an output of a voltage regulator circuit to a reference voltage through the use of a comparator circuit;

closing a switch between a supply voltage and the output of the voltage regulator circuit if the reference voltage exceeds the voltage at the output, wherein a control terminal of the switch is coupled to an output of the comparator circuit;

reducing output impedance of the comparator through the use of a resistive element and a diode, the resistive element having a first terminal connected to the output of the comparator circuit and a second terminal connected to an anode terminal of the diode and to a current source, a cathode terminal of the diode being connected to a circuit ground.

12. The method of claim 11, further including smoothing the voltage at the output of the voltage regulator circuit.

13. A voltage regulator, comprising:

an operational amplifier having a non-inverting input terminal connected to a reference voltage and an inverting input terminal connected to an output terminal of the regulator;

a power switch having a first conduction terminal connected to a supply voltage, a second conduction terminal connected to the output terminal of the regulator, and a control terminal coupled to an output terminal of the operational amplifier;

filtering means for smoothing a regulated voltage at the output terminal of the voltage regulator; and an impedance reduction stage including a diode-connected transistor having a first conduction terminal and a control terminal connected to a current source and a second conduction terminal connected to a circuit ground, and a resistive element having a first terminal connected to the output terminal of the operational amplifier and a second terminal connected to the first conduction terminal of the transistor.

14. The voltage regulator of claim 13 wherein the filtering means is a charge capacitor having a first terminal connected to the output terminal of the voltage regulator, and a second terminal connected to the circuit ground.

15. The voltage regulator of claim 13 wherein the transistor is an N-channel MOS transistor and the first conduction terminal is a drain terminal, the second conduction terminal is a source terminal, and the control terminal is a gate terminal.

16. The voltage regulator of claim 13 wherein the power switch is a P-channel MOS transistor and the first conduction terminal is a source terminal, the second conduction terminal is a drain terminal, and the control terminal is a gate terminal.

17. The voltage regulator of claim 16, further including an inverting amplifier stage having an input terminal connected to the output terminal of the operational amplifier and an output terminal connected to the control terminal of the power switch.

18. The voltage regulator of claim 13 wherein the supply voltage is provided by a battery.

19. The voltage regulator of claim 17 wherein a voltage drop across the diode-connected transistor is selected to be substantially equal to a voltage difference between the input terminal of the inverting amplifier stage and the circuit ground.

20. A voltage regulator having an output terminal adapted to being connected to a load, including:

an operational amplifier having a non-inverting input connected to a first reference voltage, and an inverting input connected to the output terminal, an inverting stage having an input connected to the output of the operational amplifier, a power switch controlled by an output of the inverter stage, arranged between the output terminal and a supply voltage, a charge capacitor arranged between the output terminal and a reference supply voltage, and means for reducing the effective output impedance of the operational amplifier, including a first resistor having a first terminal connected to the output of the operational amplifier, a diode-connected MOS transistor having a drain connected to a second terminal of the first resistor and a source connected to the second reference voltage, and means for biasing the diode-connected transistor in the on state.

21. The voltage regulator of claim 20, wherein the first resistance has a value much smaller than the output impedance of the operational amplifier.

22. The voltage regulator of claim 21, wherein the operational amplifier includes:

first and second MOS transistors, of a first type, having sources connected to each other and gates respectively connected to the inverting and non-inverting inputs, a current source arranged between the supply voltage and the sources of the first and second transistors, third and fourth MOS transistors, of a second type, having sources connected to the first reference voltage, having gates connected to each other, and having drains respectively connected to drains of the first and second transistors, the drain of the first transistor being connected to the output of the operational amplifier and the drain and the gate of the fourth transistor being interconnected.

23. The voltage regulator of claim 22, wherein the inverting stage includes:

a fifth MOS transistor, of the type of the third and fourth transistors, having a gate and a drain respectively connected to the input and to the output of the inverting stage, and having a source connected to the first reference voltage, an impedance arranged between the output of the inverting stage and the supply voltage, and a capacitor and a second resistor arranged in series between the input and the output of the inverting stage.

24. The voltage regulator of claim 22, wherein the power switch is a sixth MOS transistor of the type of the first and second transistors.

25. The voltage regulator of claim 23, wherein the first, second, and sixth transistors are P-channel MOS transistors and wherein the third, fourth, and fifth transistors are N-channel MOS transistors.

* * * * *